United States Patent [19]

Sendoykas

[11] 4,281,433

[45] Aug. 4, 1981

[54] COMPOUND TOOL

[76] Inventor: Jack J. Sendoykas, 23510 Denton, Apt. 227 T, Mt. Clemens, Mich. 48083

[21] Appl. No.: 115,423

[22] Filed: Jan. 25, 1980

[51] Int. Cl.[3] ..... A47L 1/08; A47L 23/04

[52] U.S. Cl. ..... 15/105; 15/113; 15/114; 15/117

[58] Field of Search ..... 15/105, 111, 113, 114, 15/117, 121, 236 R, 245

[56] References Cited

U.S. PATENT DOCUMENTS

| | | | |
|---|---|---|---|
| 3,051,975 | 9/1962 | Schwartz | 15/105 |
| 3,307,212 | 3/1967 | MacInnes | 15/111 |
| 3,787,921 | 1/1974 | Feldmann | 15/105 |
| 3,968,535 | 7/1976 | Nichols | 15/117 X |
| 3,995,345 | 12/1976 | Larsson | 15/117 X |

*Primary Examiner*—Chris K. Moore

*Attorney, Agent, or Firm*—Harness, Dickey & Pierce

[57] ABSTRACT

A multi-purpose tool adapted particularly for use with automotive vehicles and having a handle and an ice breaker arranged in such relation to each other and to a brush, a shoe scraper, a snow scraper and a squeegee as to be most convenient for use. When the tool is held manually by the handle with the ice breaker on the ground, the shoe scraper is positioned for convenient use, and the brush, squeegee, and snow scraper are held above and clear of the ground so that they are kept clean.

13 Claims, 4 Drawing Figures

FIG. 1.
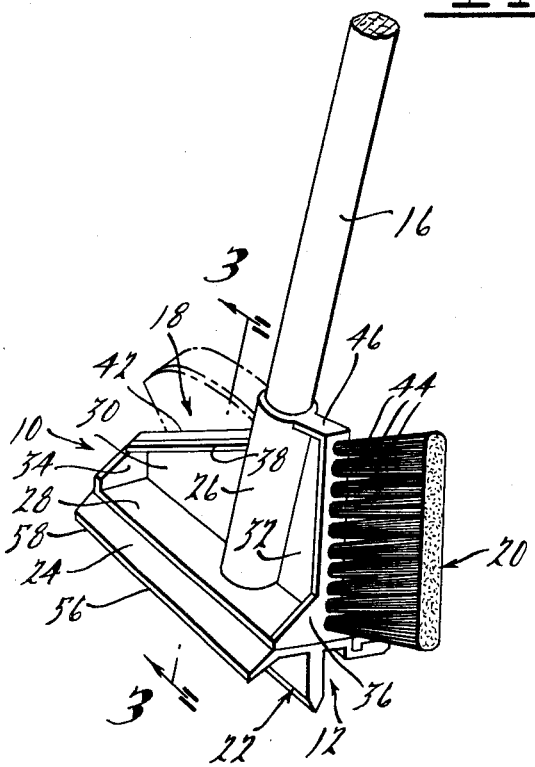
FIG. 3.
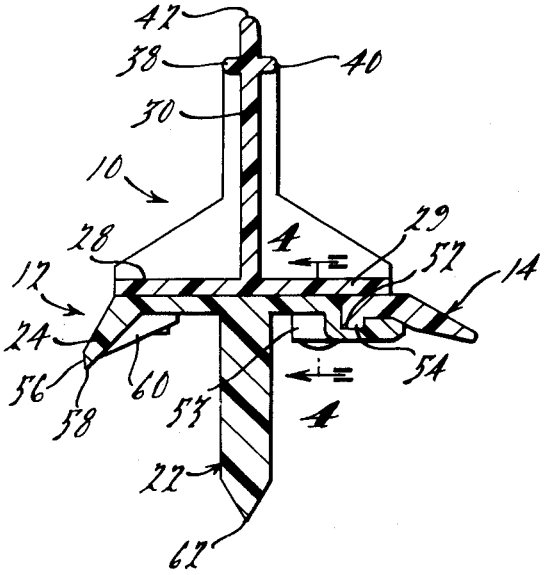
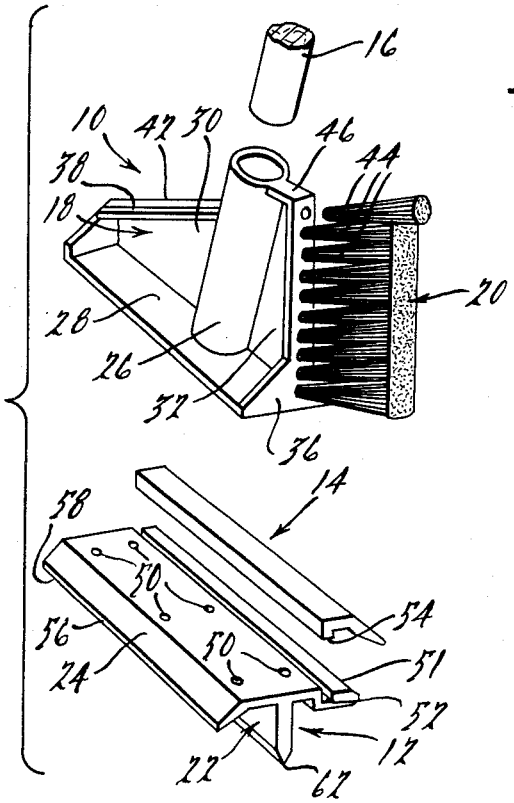
FIG. 2.
FIG. 4.
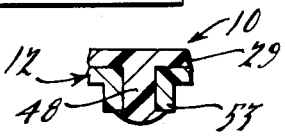

COMPOUND TOOL

BACKGROUND OF THE INVENTION

Multi-purpose tools of the general type involved here are disclosed in the Nichols U.S. Pat. No. 3,968,535 dated July 13, 1976; the Mallory U.S. Pat. No. 3,724,017 dated Apr. 3, 1973; the MacInnes U.S. Pat. No. 3,307,212 dated Mar. 7, 1967; the Schwartz U.S. Pat. No. 3,051,975 dated Sept. 4, 1962; the Vosbikian U.S. Pat. No. 2,534,086 dated Dec. 12, 1950; the Coover U.S. Pat. No. 960,276 dated June 7, 1910; and the Urmston U.S. Pat. No. 603,581 dated May 3, 1898. However, none of these prior art tools have the particular operating components of the tool disclosed herein, and none of them show the particular arrangement and correlation of components that gives the instant tool its enhanced utility and versatility in use.

SUMMARY OF THE INVENTION

The multi-purpose tool of this invention has a handle provided with an ice breaker that extends longitudinally from one end thereof and brush, shoe scraper, snow scraper and squeegee members extending laterally from the handle behind the ice breaker. This arrangement of the operational components positions the ice breaker so that leverage on the handle applies maximum force for breaking and removing a layer of ice from a windshield for example and the other members are unobstructedly positioned so as not to interfere with the use and manipulation of the ice breaker. In addition, the shoe scraper is disposed facing the handle, and it is in such relation to the handle that it is positioned for maximum convenience in use when the tool is held by the handle with the ice breaker resting on the ground. Particularly significant in this latter regard is the fact that the other members; namely, the brush, the snow scraper and the squeegee, are disposed above and free of the ground when the shoe scraper is being used and are thus prevented from being dirtied.

In addition to the foregoing, the compound tool of this invention is uniquely designed so that the main body and tool holding portions thereof can be produced inexpensively by injection molding from a suitable plastic resin material. The body of the tool is designed in two parts that are uniquely correlated to clamp and firmly hold the squeegee, and the body parts themselves are formed so that they can be assembled with the squeegee and staked together easily and quickly.

Still another feature of the invention is that the brush and shoe scraper are on, and in the case of the shoe scraper integral with, one part of the body while the ice breaker and snow scraper are formed integrally and in one piece with the other part of the body so that all of the operational components are assembled together automatically in proper relation to each other when the two body parts are assembled in interfitting clamping engagement with the squeegee and staked together in the manner previously described.

DESCRIPTION OF THE DRAWINGS

FIG. 1 is an isometric view showing the multi-purpose tool of this invention;

FIG. 2 is an exploded perspective view showing the various parts and operational components of the tool;

FIG. 3 is a longitudinal sectional view taken on the line 3—3 of FIG. 1; and

FIG. 4 is a fragmentary longitudinal sectional view taken on the line 4—4 of FIG. 3.

DESCRIPTION OF THE PREFERRED EMBODIMENT

In the drawing, wherein for the purpose of illustration is shown a preferred embodiment of the invention, the numeral 10 designates the main body portion of the tool and the numeral 12 designates a supplemental body portion in the form of a cap member that is adapted to be suitably attached to the body 10 with a squeegee 14 clamped securely therebetween. A handle 16 is attached to the body 10 and a shoe scraper 18 and a brush 20 extend laterally in opposite directions from the handle mounting portion of the body. An ice breaker 22 extends longitudinally from the cap member 12 and a snow scraper 24 is provided on one edge of the cap member. Both the body 10 and the cap member 12 preferably are formed from a suitably strong and durable plastic resin material so that they can be die cast inexpensively for assembly by mass production methods.

More particularly, the main body portion 10 is formed with an integral longitudinal tubular portion 26 that is open at its ends to receive a terminal end portion of the handle 16. As shown in the drawing, the handle 16 fits snugly in the body portion 26 and the latter is sufficiently long to provide a firm grip on the handle and to spread the leverage forces exerted on the body 10 by the handle in the use of the tool. In order to prevent air from being trapped in the tubular portion 26 when the handle 16 is inserted therein and to permit ready insertion of the handle, the portion 26 is open at the forward end of the body 10 as well as at the rearward end thereof. If desired, the handle 16 can be permanently joined to the body 10 by a suitable adhesive or the like. However, in practice, the handle 16 preferably is of wood and, in this event, it can be readily detachably fastened to the body 10 in any suitable manner as by a cross pin (not shown) or by a screw (not shown) in a conventional manner. On the other hand, if the handle 16 is made to fit the socket provided by the tubular portion 26 relatively snugly as shown and the tubular portion is made sufficiently long, the body 10 will be attached sufficiently securely to the handle without additional fastening means so that they will not come apart during normal use of the tool. At the same time the handle 16 can be separated from the body 10 if desired for convenient packaging or shipment and during periods of nonuse.

Lateral flanges 28 and 29 on the body 10 extending in a plane at right angles to the handle mounting portion 26 at the forward end of the latter form a base to which the cap member 12 can be attached. Laterally extending longitudinal fins or vanes 30 and 32 are formed integrally with the tubular portion 26 and with the base flanges 28 and 29. Reinforcing integral flanges 34 and 36 extending longitudinally rearwardly from the base flanges 28 and 29 at the outer ends of the fins 30 and 32 strengthen the latter and provide additional support for the shoe scraper 18 and the brush 20.

The upper, rearwardly facing edge of the vane 30 at one side of the handle mounting portion 26 is formed to provide a shoe scraper and, if necessary or desirable, it can be provided at opposite sides and adjacent the scraping edge thereof with narrow strengthening and reinforcing ribs 38 and 40. It is desirable of course that the reinforcing ribs 38 and 40 be integrally joined at the ends thereof to the handle mounting tubular portion 26 and to the end flange 34. In order better to perform its intended function, the scraping edge 42 desirably is straight, and to dispose the scraping edge for maximum convenience in use it is inclined obliquely with respect to the handle 16. This laterally and forwardly inclined disposition of the edge 42 positions it for maximum convenience in use when the tool is held manually by the handle 16 with the tool extending downwardly in front of the person using it and preferably with the lower end of the tool resting on the ground.

The strengthening and reinforcing flange 36 at the side of the tool opposite the shoe scraper 18 provides a mounting base for the brush 20 which preferably is formed from polypropylene strands or filaments of suitable length grouped together in bundles 44, as shown in FIGS. 1 and 2. All of the filaments forming the brush bristles preferably are of the same length and they are fused at one end to the outer surface of the flange 36 by conventional ultrasound welding procedures. If desired, the brush mounting flange 36 can be further strengthened and reinforced by a transverse flange 46 extending between it and the tubular portion 26 at the rearward end of the latter.

The cap member 12 preferably is the same size and shape as the body base flanges 28 and 29 and the cap member is joined permanently to the flanges at final assembly in any suitable or conventional manner. In the particular form of the invention here shown, the cap member 12 and the base flanges 28 and 29 are fastened together by two series of studs 48 formed integrally on and extending forwardly from the base flanges 28 and 29. When the cap member 12 is superimposed on the flanges 28, 29, the studs 48 extend through and project from openings 50 in the cap member. The openings 50 preferably are in embossments 53 formed on the front face of the cap member 12 to provide additional support and bearing surfaces for the studs 48. As perhaps best shown in FIG. 2, the cap member 12 is formed in its rearward or inner side and adjacent one edge 51 thereof with a longitudinal groove 52 that receives and snugly fits a laterally extending longitudinal rib 54 on the squeegee 14. As shown, the squeegee preferably extends the full length of the cap member. At assembly, the squeegee 14 is placed on the cap member 12 with the rib 54 in the groove 52, and the cap member is then mounted on the flanges 28 and 29 with the studs 48 extending forwardly through the openings 50. This operation preferably is performed in a suitable fixture that holds the cap member 12 and the flanges 28 and 29 together under pressure and, while the parts are being held in this manner, the projecting ends of the studs 48 are staked as shown in FIG. 4 to join the parts securely and permanently with the inner edge portion of the squeegee 14 clamped securely therebetween. Thereafter, the interfitting groove 52 and rib 54 prevent the squeegee 14 from pulling out from between the cap member 12 and the flange 29. Manifestly, when the cap member 12 is fastened to the mounting flanges 28 and 29 in the manner described, it closes the forward end of the tubular portion 26 and thus limits the extent to which the handle 16 can be inserted into the tubular portion. Desirably, the forward end of the handle should seat against the cap member 12 to assure full length retention of the handle by the tubular portion.

Both the snow scraper 24 and the ice breaker 22 are formed integrally and in one piece with the cap member 12. As clearly shown in the drawing, the snow scraper 24 is formed at one longitudinal edge of the cap member 12 and it preferably extends for the full length of the edge on which it is formed. Also, as shown in the drawing, the snow scraper 24 extends angularly forwardly and laterally from the edge of the cap member 12 and the outer scraping edge thereof preferably is beveled as at 56 to provide a relatively thin scraping edge 58. If necessary or desirable, the angularly forwardly and laterally outwardly inclined snow scraper 24 can be suitably reinforced by transverse ribs 60 at the forward or outer side thereof.

The ice breaker 22 is disposed longitudinally in alignment with the tubular member 26 and the handle 16 and, since the ice breaker normally is subjected to heavy pressures in use, it preferably is relatively thick and strong, as perhaps best shown in FIG. 3, and it is formed with a beveled scraping edge 62 at the forward end thereof. The ice breaker 22 ideally should be of lesser width than the length of the cap member 12 of which it is a part and the scraping edge 62 thereof preferably is convex in form, as shown in FIGS. 1 and 2, to facilitate manipulation thereof in use. The location of the ice breaker directly forwardly of and inline with the tubular body portion 26 strengthens and reinforces the cap member 12 at the point where the handle 26 applies maximum pressure in the use of the ice breaker 22 and it also places the ice breaker directly in-line with the handle 16 so that maximum leverage is applied by the handle to the ice breaker as required for efficient and effective use of the latter.

In the manufacture of the tool, the bristles of the brush 20 are fused to the main body portion 10 prior to assembly. All of the other tool components except the squeegee 14 are formed either on the body 10 or on the cap member 12 during the injection molding operations. Thus, the only operation required at final assembly is the placement of the cap member 12 on the body 10 with the squeegee 14 therebetween and staking of the studs 48. The arrangement of the tool components permits both the body 10 and cap member 12 to be made of plastic resin without sacrificing strength required in the use of the various tool components, and the fact that the two main parts of the tool may be injection molded from suitable plastic resin material greatly facilitates the assembly operation and makes the final product relatively inexpensive. Also, the simple assembly procedure makes it possible to produce large numbers of the tool in a minimum of time.

I claim:

1. A multi-purpose tool for automotive vehicles and the like having a handle and an ice breaker extending longitudinally in opposite directions and having also a brush, a shoe scraper, a snow scraper and a squeegee extending laterally therefrom in different directions behind said ice breaker, said tool adapted to be held manually by the handle with said ice breaker on the ground and when said tool is so placed said ice breaker supporting said brush, said squeegee and said snow scraper above and clear of the ground and said shoe scraper in position for use.

2. The multi-purpose tool defined by claim 1 wherein said shoe scraper has a scraping edge facing longitudinally of said tool generally in the direction of said handle.

3. The multi-purpose tool defined by claim 2 wherein said scraping edge extends laterally from and is in generally obtuse angular relation with respect to said handle.

4. The multi-purpose tool defined by claim 1 wherein said shoe scraper is formed with a scraping edge sloping laterally outwardly and away from said handle.

5. The multi-purpose tool for automotive vehicles defined by claim 1 wherein said shoe scraper and said brush extend laterally in opposite directions from said handle, said brush having elongate bristles extending in acute angular relation with respect to said handle, and said shoe scraper having a scraping edge extending oppositely away from but substantially parallel to the bristles of said brush.

6. The multi-purpose tool defined by claim 1 having interconnected two-part means, one of said parts being attached to said handle and portions thereof defining said shoe scraper and providing a mounting for said brush, the other of said parts coacting with said one part to clamp and securely hold said squeegee and having portions thereof defining said ice breaker and said snow scraper.

7. The multi-purpose tool defined by claim 6 wherein said squeegee and said snow scraper are disposed behind, laterally of, and at opposite sides of said ice breaker.

8. The multi-purpose tool defined by claim 1 including a main body member having a bore extending therethrough and a base portion extending substantially at right angles to said bore adjacent one end of the latter, said main body member carrying said shoe scraper and said brush at opposite sides of said bore and behind said base portion, one end portion of said handle being disposed in and snugly fitting said bore; and a cap member on and fastened to said base portion cooperating with the latter to clamp and securely hold said squeegee and also carrying said snow scraper and said ice breaker.

9. The multi-purpose tool defined by claim 8 wherein said squeegee and said snow scraper are spaced laterally apart at opposite sides of said cap member and on opposite sides of and longitudinally behind said ice breaker.

10. The multi-purpose tool defined by claim 8 wherein said cap member overlays said base portion and extends across one end of said bore to provide a seat for the end of said handle disposed in the bore.

11. The multi-purpose tool defined by claim 10 wherein said ice breaker is on and a part of said cap member in-line with said bore and said handle, whereby thrust is imposed on said cap member and said ice breaker in use by said handle, and whereby said ice breaker strengthens and reinforces said cap member in the area of said bore.

12. The multi-purpose tool defined by claim 8 wherein said main body member and said cap member are die cast from plastic resin material, and wherein the base portion of said main body member is formed with studs extending through and projecting from openings in said cap member, the projecting portions of said studs being staked to fasten said cap member to the base portion of said main body member.

13. The multi-purpose tool defined by claim 12 wherein the bristles of said brush are fused to said main body member and said shoe scraper is formed integrally and in one piece with said main body member, and wherein said ice breaker and said snow scraper are formed integrally and in one piece with said cap member.

* * * * *